US008496411B2

(12) United States Patent
Taylor

(10) Patent No.: US 8,496,411 B2
(45) **Date of Patent: *Jul. 30, 2013**

(54) TWO STAGE MECHANICALLY STABILIZED EARTH WALL SYSTEM

(75) Inventor: Thomas P. Taylor, Colleyville, TX (US)

(73) Assignee: T & B Structural Systems LLC, Ft. Worth, TX (US)

( * ) Notice: Subject to any disclaimer, the term of this patent is extended or adjusted under 35 U.S.C. 154(b) by 80 days.

This patent is subject to a terminal disclaimer.

(21) Appl. No.: 13/012,607

(22) Filed: Jan. 24, 2011

(65) Prior Publication Data

US 2011/0182673 A1 Jul. 28, 2011

Related U.S. Application Data

(63) Continuation-in-part of application No. 12/132,750, filed on Jun. 4, 2008, now Pat. No. 7,891,912, and a continuation-in-part of application No. 12/837,347, filed on Jul. 15, 2010.

(51) Int. Cl.
*E02D 29/02* (2006.01)

(52) U.S. Cl.
USPC ..... 405/284; 405/286

(58) Field of Classification Search
USPC ..... 405/272, 284, 286, 302.4
See application file for complete search history.

(56) References Cited

U.S. PATENT DOCUMENTS

| | | | |
|---|---|---|---|
| 991,041 | A | 5/1911 | Toennes |
| RE13,299 | E | 10/1911 | Denison |
| 1,144,143 | A | 6/1915 | McGillivray |
| 1,813,912 | A | 7/1931 | Clark |
| 1,959,816 | A | 5/1934 | Crum |
| 1,992,785 | A | 2/1935 | Steuer |
| 2,137,153 | A | 11/1938 | Brozek |
| 2,208,589 | A | 7/1940 | Leemhuis |
| 2,275,933 | A | 3/1942 | Werner |

(Continued)

FOREIGN PATENT DOCUMENTS

| | | |
|---|---|---|
| EP | 427221 A | 5/1991 |
| EP | 0679768 | 2/1995 |

(Continued)

OTHER PUBLICATIONS

International Application No. PCT/US08/69011—International Search Report and Written Opinion dated Oct. 10, 2008.

(Continued)

*Primary Examiner* — Tara M. Pinnock
*Assistant Examiner* — Benjamin Fiorello
(74) *Attorney, Agent, or Firm* — Edmonds & Nolte, PC

(57) ABSTRACT

A two-stage MSE system for securing a facing to an earthen formation is disclosed. The system includes a wire grid laterally-offset from the facing and a formation anchor coupled to the wire grid. The formation anchor includes a face plate, a wave plate, and an eyebolt extensible through the face plate and wave plate to secure the plates on opposing sides of the wire grid. The wave plate has transverse protrusions that align with and seat adjacent vertical wires of the facing. A facing anchor is coupled to the facing and a turnbuckle assembly secures the facing to the wire grid by coupling to the facing anchor and the formation anchor. A soil reinforcing element may also be attached to the formation anchor.

12 Claims, 4 Drawing Sheets

U.S. PATENT DOCUMENTS

| | | | | |
|---|---|---|---|---|
| 2,316,712 | A | | 4/1943 | Prince |
| 2,327,640 | A | | 8/1943 | Hendry |
| 2,552,712 | A | | 5/1951 | Ellis |
| 2,703,963 | A | | 3/1955 | Gutierrez |
| 2,881,614 | A | | 4/1959 | Preininger |
| 3,597,928 | A | | 8/1971 | Pilaar |
| 3,680,748 | A | | 8/1972 | Brunhuber |
| 3,998,022 | A | | 12/1976 | Muse |
| 4,075,924 | A | | 2/1978 | McSherry |
| 4,116,010 | A | | 9/1978 | Vidal |
| 4,117,686 | A | | 10/1978 | Hilfiker |
| 4,123,881 | A | | 11/1978 | Muse |
| 4,134,241 | A | | 1/1979 | Walton |
| 4,286,895 | A | | 9/1981 | Poli |
| 4,324,508 | A | | 4/1982 | Hilfiker |
| 4,329,089 | A | | 5/1982 | Hilfiker |
| 4,341,491 | A | | 7/1982 | Neumann |
| 4,343,572 | A | | 8/1982 | Hilfiker |
| 4,391,557 | A | | 7/1983 | Hilfiker |
| 4,411,255 | A | | 10/1983 | Lee |
| 4,470,728 | A | | 9/1984 | Broadbent |
| 4,505,621 | A | | 3/1985 | Hilfiker |
| 4,514,113 | A | | 4/1985 | Neumann |
| 4,616,959 | A | | 10/1986 | Hilfiker |
| 4,643,618 | A | | 2/1987 | Hilfiker |
| 4,651,975 | A | | 3/1987 | Howell |
| 4,653,962 | A | | 3/1987 | McKittrick |
| 4,661,023 | A | | 4/1987 | Hilfiker |
| 4,664,552 | A | | 5/1987 | Schaaf |
| 4,710,062 | A | | 12/1987 | Vidal |
| 4,725,170 | A | | 2/1988 | Davis |
| 4,834,584 | A | | 5/1989 | Hilfiker |
| 4,856,939 | A | | 8/1989 | Hilfiker |
| 4,914,876 | A | | 4/1990 | Forsberg |
| 4,920,712 | A | | 5/1990 | Dean, Jr. |
| 4,929,125 | A | | 5/1990 | Hilfiker |
| 4,952,098 | A | | 8/1990 | Grayson |
| 4,961,673 | A | | 10/1990 | Pagano |
| 4,968,186 | A | | 11/1990 | Ogorchock |
| 4,993,879 | A | | 2/1991 | Hilfiker |
| 5,044,833 | A | | 9/1991 | Wilfiker |
| 5,066,169 | A | | 11/1991 | Gavin |
| 5,076,735 | A | | 12/1991 | Hilfiker |
| 5,139,369 | A | | 8/1992 | Jaecklin |
| 5,156,496 | A | | 10/1992 | Vidal |
| 5,190,413 | A | | 3/1993 | Carey |
| 5,207,038 | A | | 5/1993 | Negri |
| RE34,314 | E | | 7/1993 | Forsberg |
| 5,257,880 | A | | 11/1993 | Janopaul |
| 5,259,704 | A | | 11/1993 | Orgorchock |
| 5,417,523 | A | | 5/1995 | Scales |
| 5,451,120 | A | | 9/1995 | Martinez-Gonzalez |
| 5,456,554 | A | | 10/1995 | Barrett |
| 5,474,405 | A | | 12/1995 | Anderson |
| D366,191 | S | | 1/1996 | Gay |
| 5,484,235 | A | | 1/1996 | Hilfiker |
| 5,487,623 | A | | 1/1996 | Anderson |
| 5,494,379 | A | | 2/1996 | Anderson |
| 5,507,599 | A | | 4/1996 | Anderson |
| 5,522,682 | A | | 6/1996 | Egan |
| 5,525,014 | A | | 6/1996 | Brown |
| 5,531,547 | A | * | 7/1996 | Shimada ..... 405/262 |
| 5,533,839 | A | | 7/1996 | Shimada |
| 5,582,492 | A | | 12/1996 | Doyle |
| 5,622,455 | A | | 4/1997 | Anderson |
| 5,702,208 | A | | 12/1997 | Hilfiker |
| 5,722,799 | A | | 3/1998 | Hilfiker |
| 5,730,559 | A | | 3/1998 | Anderson |
| 5,733,072 | A | | 3/1998 | Hilfiker |
| D393,989 | S | | 5/1998 | Groves |
| 5,749,680 | A | | 5/1998 | Hilfiker |
| 5,797,706 | A | | 8/1998 | Segrestin |
| 5,807,030 | A | | 9/1998 | Anderson |
| 5,820,305 | A | | 10/1998 | Taylor |
| 5,947,643 | A | | 9/1999 | Anderson |
| 5,951,209 | A | | 9/1999 | Anderson |
| 5,971,699 | A | | 10/1999 | Winski |
| 5,975,809 | A | | 11/1999 | Taylor |
| 5,975,810 | A | | 11/1999 | Taylor |
| 6,024,516 | A | * | 2/2000 | Taylor et al. ..... 405/262 |
| 6,050,748 | A | | 4/2000 | Anderson |
| 6,079,908 | A | | 6/2000 | Anderson |
| 6,086,288 | A | | 7/2000 | Ruel |
| D433,291 | S | | 11/2000 | Shamoon |
| 6,186,703 | B1 | | 2/2001 | Shaw |
| 6,336,773 | B1 | | 1/2002 | Anderson |
| 6,345,934 | B1 | | 2/2002 | Jailloux |
| 6,357,970 | B1 | | 3/2002 | Hilfiker |
| 6,517,293 | B2 | | 2/2003 | Taylor |
| 6,595,726 | B1 | | 7/2003 | Egan |
| 6,793,436 | B1 | | 9/2004 | Ruel |
| 6,802,675 | B2 | | 10/2004 | Timmons |
| 6,857,823 | B1 | | 2/2005 | Hilfiker |
| 6,939,087 | B2 | | 9/2005 | Ruel |
| 7,033,118 | B2 | | 4/2006 | Hilfiker |
| 7,073,983 | B2 | | 7/2006 | Hilfiker |
| 7,270,502 | B2 | | 9/2007 | Brown |
| 7,281,882 | B2 | | 10/2007 | Hilfiker |
| 7,399,144 | B2 | | 7/2008 | Kallen |
| D599,630 | S | | 9/2009 | Taylor |
| 7,722,296 | B1 | | 5/2010 | Taylor |
| 7,891,912 | B2 | | 2/2011 | Taylor |
| 7,972,086 | B2 | | 7/2011 | Taylor |
| 7,980,790 | B2 | | 7/2011 | Taylor |
| 8,079,782 | B1 | | 12/2011 | Hilfiker |
| 2002/0044840 | A1 | * | 4/2002 | Taylor et al. ..... 405/259.1 |
| 2002/0067959 | A1 | | 6/2002 | Thornton |
| 2003/0223825 | A1 | * | 12/2003 | Timmons et al. ..... 405/285 |
| 2004/0018061 | A1 | | 1/2004 | Jansson |
| 2004/0161306 | A1 | | 8/2004 | Ruel |
| 2004/0179902 | A1 | | 9/2004 | Ruel |
| 2005/0111921 | A1 | | 5/2005 | Taylor |
| 2005/0163574 | A1 | | 7/2005 | Hilfiker |
| 2005/0271478 | A1 | | 12/2005 | Ferraiolo |
| 2005/0286981 | A1 | | 12/2005 | Robertson |
| 2006/0204342 | A1 | | 9/2006 | Hilfiker |
| 2006/0239783 | A1 | | 10/2006 | Kallen |
| 2007/0014638 | A1 | | 1/2007 | Brown |
| 2009/0016825 | A1 | | 1/2009 | Taylor |
| 2009/0067933 | A1 | | 3/2009 | Taylor |
| 2009/0285639 | A1 | | 11/2009 | Taylor |
| 2009/0304456 | A1 | | 12/2009 | Taylor |
| 2010/0247248 | A1 | | 9/2010 | Taylor |
| 2011/0170957 | A1 | | 7/2011 | Taylor |
| 2011/0170958 | A1 | | 7/2011 | Taylor |
| 2011/0170960 | A1 | | 7/2011 | Taylor |
| 2011/0229274 | A1 | | 9/2011 | Taylor |
| 2011/0311317 | A1 | | 12/2011 | Taylor |
| 2011/0311318 | A1 | | 12/2011 | Taylor |

FOREIGN PATENT DOCUMENTS

| | | |
|---|---|---|
| FR | 530097 | 9/1921 |
| FR | 1006087 | 1/1952 |
| JP | 3114014 | 6/1991 |
| JP | 08209703 | 8/1996 |
| JP | 08326074 | 12/1996 |
| KR | 1020080058697 | 6/2008 |
| KR | 1020100027693 | 3/2010 |
| WO | WO9413890 | 6/1994 |
| WO | WO2009009369 | 1/2009 |
| WO | WO2009140576 | 11/2009 |
| WO | WO2010082940 | 7/2010 |
| WO | WO2011084983 | 7/2011 |
| WO | WO2011084986 | 7/2011 |
| WO | WO2011084989 | 7/2011 |
| WO | WO2011127349 | 10/2011 |
| WO | WO2011059807 | 12/2011 |
| WO | WO2011159808 | 12/2011 |

OTHER PUBLICATIONS

International Application No. PCT/US09/031494—International Search Report and Written Opinion dated Mar. 13, 2009.

International Application No. PCT/US09/44099—International Search Report and Written Opinion dated Aug. 12, 2009.

International Application No. PCT/US08/069011—International Preliminary Report on Patentability dated Jan. 21, 2010.

International Application No. PCT/US10/036991—International Search Report and Written Opinion dated Aug. 2, 2010.
International Application No. PCT/US09/44099—International Preliminary Report on Patentability dated Nov. 25, 2010.
International Application No. PCT/US2010/036991—International Preliminary Examination Reported mailed Jul. 14, 2011.
International Application No. PCT/US09/0031494—International Preliminary Report on Patentability dated Jul. 19, 2011.
International Application No. PCT/US2010/036991—Corrected International Preliminary Examination Report mailed Aug. 15, 2011.
International Application No. PCT/US2011/031688—International Search Report and Written Opinion dated Nov. 30, 2011.
International Application No. PCT/US2011/040540—International Search Report and Written Opinion dated Feb. 17, 2012.
International Application No. PCT/US2011/040543—International Search Report and Written Opinion dated Feb. 21, 2012.
International Application No. PCT/US2011/040541—International Search Report and Written Opinion dated Feb. 27, 2012.
Webster's tenth edition, "Collegiate Dictionary", p. 423; 1998.

* cited by examiner

TWO STAGE MECHANICALLY STABILIZED EARTH WALL SYSTEM

CROSS-REFERENCE TO RELATED APPLICATIONS

The present application is a continuation-in-part of U.S. patent application Ser. No. 12/132,750 entitled "Two Stage Mechanically Stabilized Earth Wall System," and filed on Jun. 4, 2008. The present application also claims priority as a continuation-in-part of U.S. patent application Ser. No. 12/837,347 entitled "Mechanically Stabilized Earth Welded Wire Facing Connection System and Method," and filed on Jul. 15, 2010. The contents of each priority application are hereby incorporated by reference in their entirety to the extent these applications are consistent with the present disclosure.

BACKGROUND

Retaining wall structures that use horizontally-positioned soil inclusions to reinforce an earth mass in combination with a facing element are referred to as mechanically stabilized earth (MSE) structures. MSE structures can be used for various applications including retaining walls, bridge abutments, dams, seawalls, and dikes.

The basic MSE implementation is a repetitive process in which layers of backfill and horizontally-placed soil reinforcing elements are positioned one atop the other until a desired height of the earthen structure is achieved. Typically, grid-like steel mats or welded wire mesh are used as soil reinforcing elements. In some applications, the soil reinforcing elements consist of parallel, transversely-extending wires welded to parallel, longitudinally-extending wires. Backfill material and the soil reinforcing mats are combined and compacted sequentially to form a standing earthen formation or wall.

During construction of the MSE structure, the soil reinforcing elements can be successively coupled or otherwise attached to a substantially vertical wire wall, much like a wire mesh or wire gridworks. Coupling the soil reinforcing elements to the wire wall serves to maintain the shape of the earthen formation. MSE structures derive their strength and stability from the frictional and mechanical interaction between the backfill material and the soil reinforcement elements, resulting in a permanent and predictable load transfer from backfill to reinforcements.

In a two-stage MSE system a substantially vertical wall or facing is constructed a short distance from the earthen formation. The facing may be made of, for example, concrete or metal and attached in several locations to the earthen formation, most likely to the wire wall, by a variety of mechanisms. Via this attachment, outward movement and shifting of the facing is prevented. In operation, the facing not only serves as a decorative façade, but also prevents erosion at the face of the earthen formation.

Although there are several systems and methods of constructing two-stage MSE structures, it nonetheless remains desirable to find improved systems and methods offering less expensive alternatives and greater resistance to shear forces inherent in such structures.

SUMMARY

Embodiments of the disclosure may provide a system for securing a facing to an earthen formation. The system may include a wire grid laterally-offset from the facing and being fixed relative to the earthen formation in a substantially vertical position, the wire grid having a plurality of vertical wires coupled to a plurality of cross wires. The system may further include a formation anchor comprising a first plate defining a first hole, a second plate defining a second hole, and an eyebolt defining an aperture and having a stem extending from the aperture, wherein the stem is extensible through the first hole, the wire grid, and the second hole, successively, in order to couple the formation anchor to the wire grid. The system may also include a facing anchor coupled to the facing, and a turnbuckle housing having boreholes defined at first and second ends thereof, wherein a first connector is threadably coupled to the first end and also coupled to the formation anchor, and a second connector is threadably coupled to the second end and also coupled to the facing anchor.

Embodiments of the disclosure may further provide a method for securing a facing to an earthen formation. The method may include fixing a wire grid relative to the earthen formation in a substantially vertical position, the wire grid having a plurality of vertical wires coupled to a plurality of cross wires, and coupling a formation anchor to the wire grid, the formation anchor comprising a first plate defining a first hole, a second plate defining a second hole, and an eyebolt defining an aperture and having a stem extending therefrom, the stem being extensible through the first hole, the wire grid, and the second hole, successively. The method may further include positioning the facing laterally-offset a distance from the wire grid, the facing having a facing anchor coupled thereto, coupling a distal end of a first connector to the aperture of the formation anchor, and coupling a distal end of a second connector to the facing anchor. The method may also include coupling a proximal end of the first connector to a first threaded borehole of a turnbuckle housing, coupling a proximal end of the second connector to a second threaded borehole of the turnbuckle housing, and rotating the turnbuckle housing to adjust the distance.

Embodiments of the disclosure may further provide another system for securing a facing to an earthen formation. The other system may include a wire grid laterally-offset from the facing and fixed relative to the earthen formation in a substantially vertical position, the wire grid having a plurality of vertical wires coupled to a plurality of cross wires. The system may further include a formation anchor comprising a first plate defining a first hole, a second plate defining a second hole, and an eyebolt defining an aperture and having a stem extending therefrom, wherein the stem is extensible through the first hole, the wire grid, and the second hole, successively. The system may also include a soil reinforcing element comprising a plurality of transverse wires coupled to at least two longitudinal wires having lead ends that converge and are coupled to a coil, a facing anchor coupled to the facing, and a turnbuckle housing having boreholes defined at first and second ends thereof, wherein a first connector is threadably coupled to the first end and also coupled to the formation anchor, and a second connector is threadably coupled to the second end and also coupled to the facing anchor.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
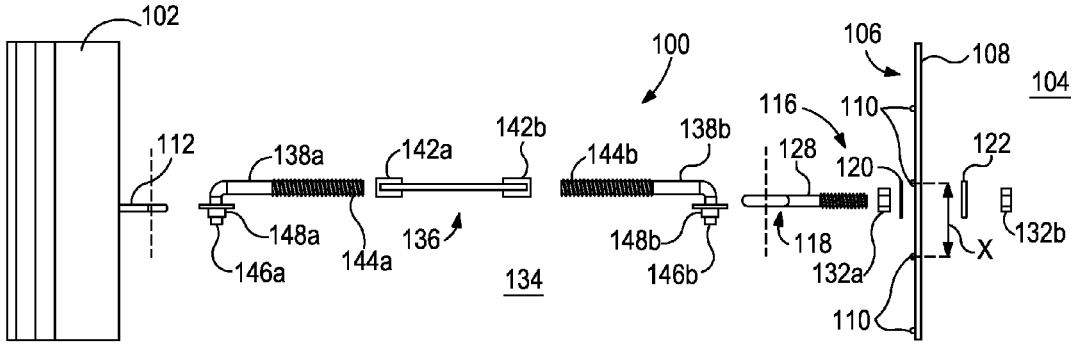
FIG. 1A illustrates an exploded side view of an exemplary two-stage MSE system, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 1B:
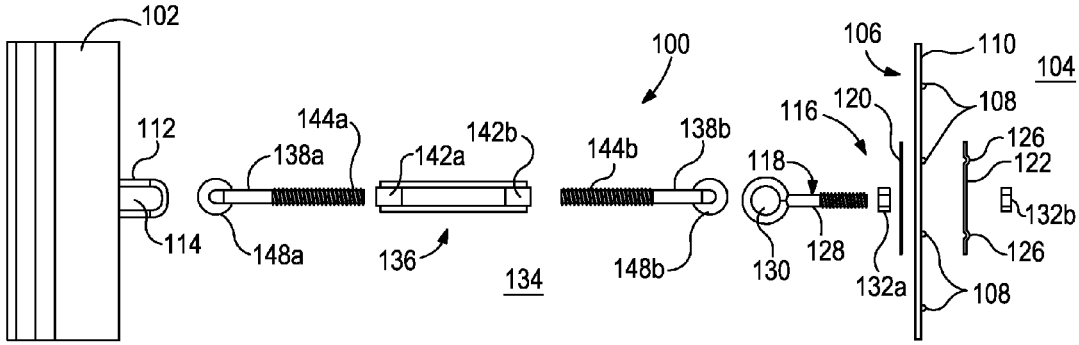
FIG. 1B illustrates an exploded plan view of the two-stage MSE system shown in FIG. 1A.

FIGS. 1A and 1B illustrate side and plan views, respectively, of an exemplary two-stage MSE system 100, according to one or more embodiments described. The system 100 is shown in exploded views, where each component is separated for the sake of clarity and explanation. The system 100 may be used to secure a facing 102 to an earthen formation 104 laterally-offset from the facing 102. A central cavity 134 is defined between and separates the facing 102 and the earthen formation 104. In one embodiment, the facing 102 may include an individual precast concrete panel or a plurality of interlocking precast concrete modules or wall members that are assembled into interlocking relationship. In other embodiments, the facing 102 may include a metal facing, such as steel facing sheets.

The system 100 may include a facing anchor 112 coupled or otherwise attached to the facing 102 and extending from the back face thereof toward the earthen formation 104. In one embodiment, the facing anchor 112 may be mechanically-fastened to the back face of the facing 102 with bolts or other mechanical devices, or by welds such as in applications where the facing 102 is metallic. In embodiments where the facing 102 is made of concrete, the facing anchor 112 may be cast directly into the concrete facing 102. As depicted, the facing anchor 112 may include a horizontally-disposed body that defines an aperture 114 (e.g., a formed loop). The aperture 114 extends into the cavity 134 and may open in a generally vertical direction. It will be appreciated, however, that the general design, shape, and disposition of the anchor 112 may vary without departing from the scope of the disclosure. For example, it is also contemplated to have an anchor 112 with a vertically-disposed body, or disposed at any angle between horizontal and vertical, where the aperture 114 opens in a generally horizontal direction, or opens in any direction between vertical and horizontal.

The earthen formation 104 may encompass a mechanically stabilized earth (MSE) structure including layers of backfill and horizontally-placed soil reinforcing elements (not shown) positioned one atop the other until a desired height of the formation 104 is reached. A substantially vertical wire grid 106 may be disposed against the compacted backfill on the outside surface of the earthen formation 104. In one embodiment, the wire grid 106 is configured to prevent the loosening or raveling of the backfill material between successive layers of soil reinforcing. The wire grid 106 may include a plurality of vertical wires 108 and a plurality of cross wires 110 configured substantially orthogonal to the vertical wires 108. The wire grid 106 may be made of various materials including, but not limited to, metals, plastics, ceramics, or combinations thereof. In one embodiment, the wire grid 106 may be secured to the earthen formation 104 via the soil reinforcing elements extending into the backfill.

Figure 2A:
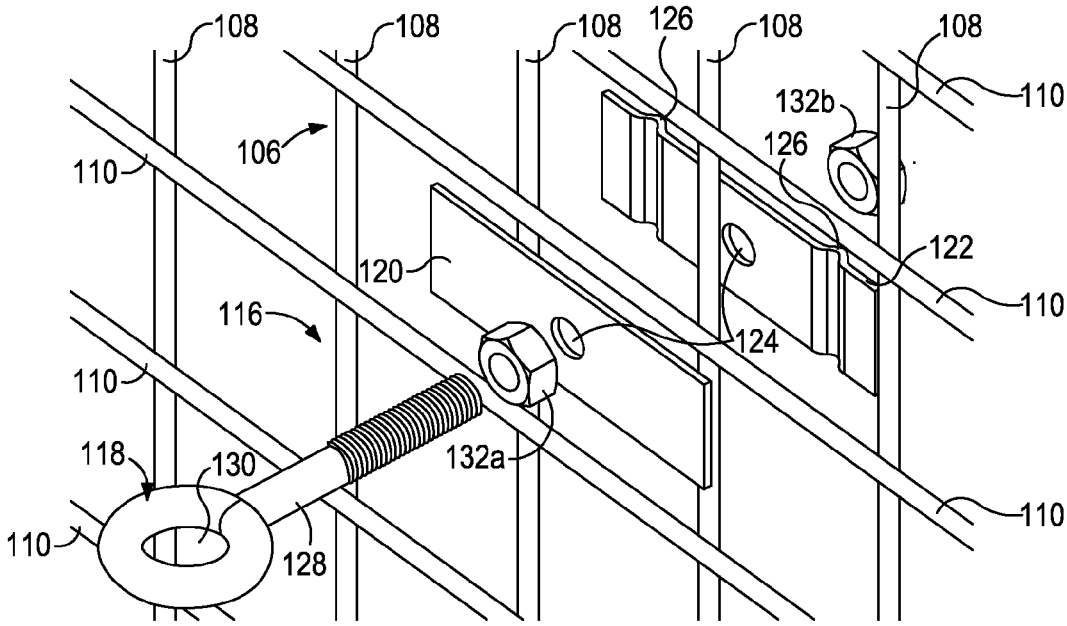
FIG. 2A illustrates an exploded, isometric view of a portion of the two-stage MSE system shown in FIG. 1A, according to one or more embodiments described.
Figure 2B:
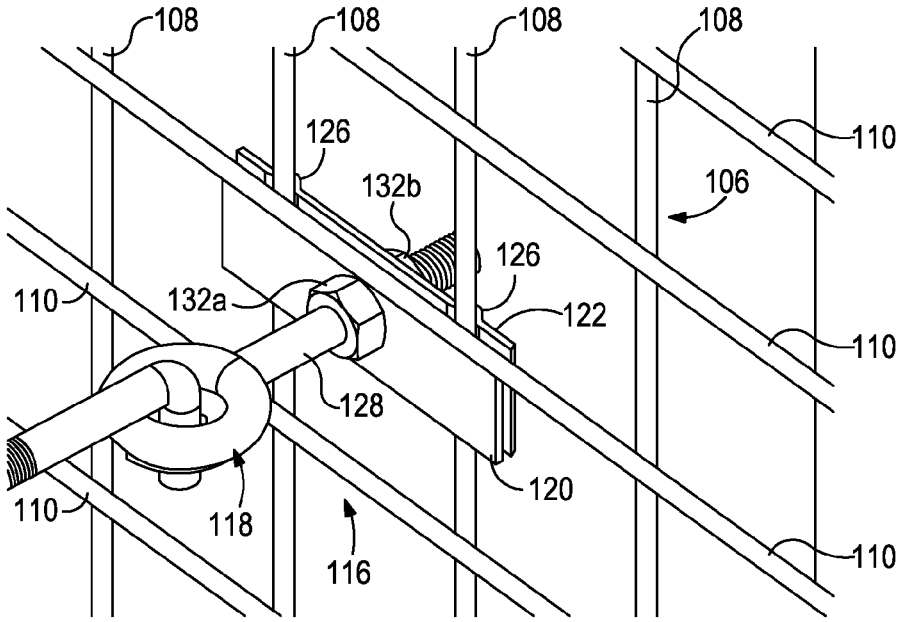
FIG. 2B illustrates an assembled, isometric view of the portion of the two-stage MSE system shown in FIG. 2A.

The system 100 may further include a formation anchor 116 coupled to or otherwise arranged on the wire grid 106. Referring to FIGS. 2A and 2B, with continued reference to FIGS. 1A and 1B, the exemplary formation anchor 116 is illustrated in exploded and assembled views, respectively. In one embodiment, the formation anchor 116 may include an eye bolt 118 adapted to be secured to the wire grid 106 with a face plate 120 and a wave plate 122. Once properly installed, the face plate 120 may be arranged against the outside surface of the wire grid 106 (e.g., adjacent the cavity 134), while the wave plate 122 is arranged on the inside surface of the wire grid 106 (e.g., adjacent the formation 104). Both the face plate 120 and the wave plate 122 may be made of or otherwise manufactured from various types of materials including, but not limited to, metals, plastics, ceramics, or combinations thereof. Moreover, both the face plate 120 and the wave plate 122 may define at least one hole 124 for the receipt of the eye bolt 118, as will be described below.

It will be appreciated, however, that the face plate 120 and the wave plate 122 may be entirely interchangeable, without departing from the scope of the disclosure. For example, in one embodiment, the wave plate 122 may be replaced with another face plate 120 such that the connector 116 is secured to the wire grid 106 using two face plates 120. Similarly, in another embodiment, the face plate 120 may be replaced with a second wave plate 122 such that the connector 116 is secured to the wire grid 106 using two wave plates 120. In yet other embodiments, the wave plate 122 may be generally arranged against the outside surface of the wire grid 106 (e.g., adjacent the cavity 134), while the face plate 122 is arranged on the inside surface of the wire grid 106 (e.g., adjacent the formation 104).

In one embodiment, the face plate 120 and the wave plate 122 may be in the general shape of a rectangle, as illustrated, and large enough to span at least two adjacent vertical wires 108 of the wire grid 106. In other embodiments, however, the plates 120, 122 may include any other geometry or shape as long as each is large enough to span the distance between two adjacent vertical wires 108. As depicted, the wave plate 122 may define at least two laterally-offset transverse protrusions 126. Each protrusion 126 may be configured to receive or otherwise seat a vertical wire 108, thereby preventing the formation anchor 116 from translating laterally. Accordingly, the protrusions 126 may be laterally-offset from each other a distance to equal or substantially equal to the distance between adjacent vertical wires 108.

The eye bolt 118 may include an elongate stem 128 extending from an aperture 130. It will be appreciated that the eye bolt 118 may be replaced with any other suitable anchoring device that may be coupled or otherwise secured to the system 100, as will be described below. A portion of the axial length of the stem 128 may be threaded in order to threadably engage one or more securing devices 132*a* and 132*b*. As depicted, the securing devices 132 may include threaded nuts, but it will be appreciated that the securing devices 132 may include any device capable of securing the stem 128 to the plates 120, 122.

To assemble the formation anchor 116 or otherwise attach it to the wire grid 106, the first securing device 132*a* is first threaded onto the stem 128. The stem 128 may then be successively extended through the hole 124 defined in the face plate 120, the wire grid 106, and the hole 124 defined in the wave plate 122. The first securing device 132*a* biases against the face plate 120 and forces the face plate 120 into contact with the outside surface of the wire grid 106. The second securing device 132*b* may then be threaded onto the end of the stem 128 and tightened until bringing the wave plate 122 into contact with the wire grid 106. As contact is made with the wire grid 106, adjacent vertical wires 108 may be aligned with and seated within the transverse protrusions 126, thereby preventing the formation anchor 116 from translating laterally once finally secured.

Adjusting the position of the securing devices 132*a,b* along the threaded portion of the stem 128 allows the eye bolt 118 to translate axially within the cavity 134. In other words, the aperture 130 may be moved closer to or farther away from the wire grid 106 by adjusting the relative position of the securing devices 132*a,b*. This may prove advantageous in applications where the lateral dispositions of several apertures 130 along the expanse of the wire grid 106 are required to be set at varying distances from the outside surface of the wire grid 106 to accommodate, for example, a vertically-undulating earthen formation 104 or facing 102.

Figure 5:
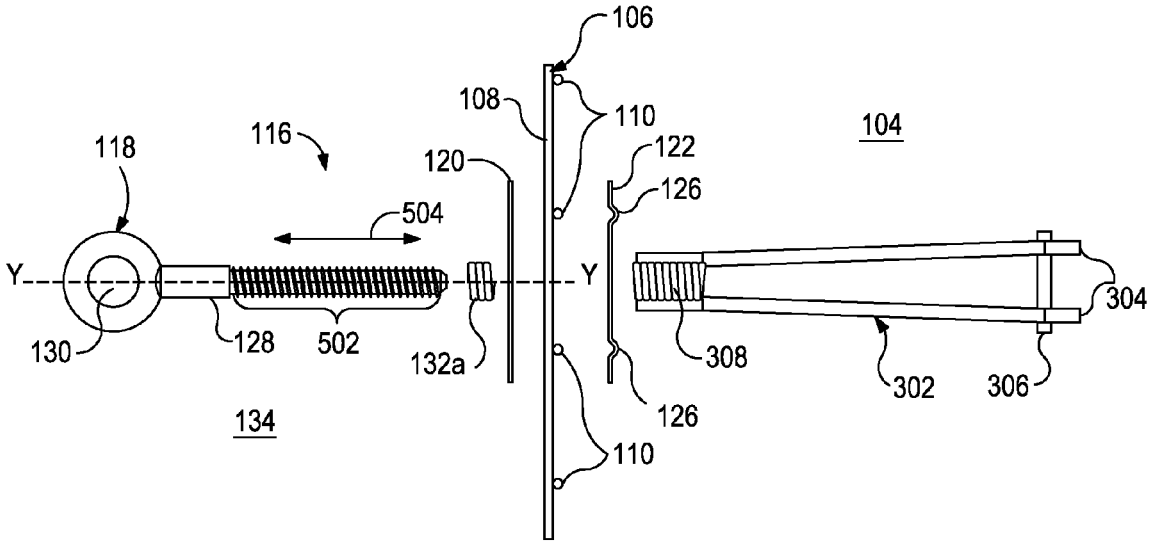
FIG. 5 illustrates an exploded plan view of another two-stage MSE system, according to one or more embodiments described.

In at least one embodiment, one or both of the holes 124 defined in the face plate 120 and wave plate 122, respectively, may be tapped and configured to receive the threads defined on the stem 128. Threading the stem 128 into one or each hole 124 may eliminate the need for one or both of the securing devices 132*a,b*. Consequently, the eye bolt 118 may be axially-translatable within the cavity 134 by rotating the eye bolt 128 about its longitudinal axis Y (FIG. 5). In other embodiments, one or both of the securing devices 132*a,b* may be attached directly to the face plate 120 or wave plate 122, thereby essentially forming an integral part of each plate 120,122. The securing devices 132*a,b* may be attached to the plates 120,122, for example, by welding processes such as resistance welding or TIG welding, and the eye bolt 118 would again be axially-translatable within the cavity 134 by rotating its longitudinal axis Y (FIG. 5).

Referring again to FIG. 1A, each cross wire 110 of the wire grid 106 may be vertically-offset from each other by a distance X. Consequently, the formation anchor 116 may be coupled to the wire grid 106 such that it is capable of shifting vertically by the distance X. This may prove advantageous in applications where either the facing 102 or the earthen formation 104, or both, settles or otherwise reacts to thermal expansion or contraction.

The system 100 may also include a turnbuckle assembly 136 generally arranged within the cavity 134 and configured to detachably secure the facing 102 to the earthen formation 104. The turnbuckle assembly 136 may include opposing connectors 138*a* and 138*b* and a turnbuckle housing 140 having two oppositely threaded boreholes 142*a* and 142*b* (i.e., one having right-hand threads and the other having left-hand threads). Each connector 138*a,b* has a proximal end 144*a* and 144*b* and a distal end 146*a* and 146*b*, where the proximal ends 144*a,b* threadably engage the threaded boreholes 142*a,b*, respectively. The distal ends 146*a* and 146*b* of each connector 138*a,b* may be coupled to the facing anchor 112 and the formation anchor 116, respectively. As the turnbuckle housing 140 is turned or otherwise rotated, the connectors 138*a,b* are either brought closer together or moved further apart, thereby either tightening or loosening the connection between the facing 102 and the earthen formation 104.

In one embodiment, each connector 138*a,b* may include an L-bolt, as depicted. In other embodiments, however, the connectors 138*a,b* may be replaced with other types of connectors suitable for connection with the facing anchor 112 and/or the formation anchor 116. For example, suitable connectors 138*a,b* may also include J-bolts or clasping mechanisms configured to be coupled to either the facing anchor 112 or the formation anchor 116. As will be appreciated, varying types of connectors 138*a,b* may be used interchangeably on either end of the turnbuckle housing 140 in order to fit several different needs or applications.

In the illustrated embodiment, the distal ends 146*a* and 146*b* of each connector 138*a,b* may be extended through the apertures 114 and 130 of each anchor 112,116, respectively, and secured against removal by threading on a nut and washer assembly 148*a* and 148*b*. Instead of using the nut and washer assemblies 148*a,b*, those skilled in the art will readily recognize that several methods of attaching the connectors 138*a,b* to the anchors 112,116, respectively, may be equally employed without departing from the scope of the disclosure. Moreover, since the eye bolt 118 of the formation anchor 116 is threaded, it is capable of 360 degree rotation about its axis, thereby rotating the relative disposition of the aperture 130.

Consequently, the distal end 146*b* of the connector 138*b* may be coupled to the formation anchor 116 at a variety of angles and in a variety of configurations to fit an equal number of designs or applications.

After the system 100 is fully assembled, and the facing 102 is adequately secured against removal from the earthen formation 104, the cavity 134 may be filled in varying degree of lift thicknesses with soil, concrete, gravel, combinations thereof, or any other viable fill material known in the art. In other embodiments, however, the cavity 134 may be left empty in the event that future adjustments to the system 100 need to be made. For example, the turnbuckle assembly 136 may be subsequently adjusted in order to account for settling or thermal contraction/expansion of either the facing 102 or the earthen formation 104.

Figure 3A:
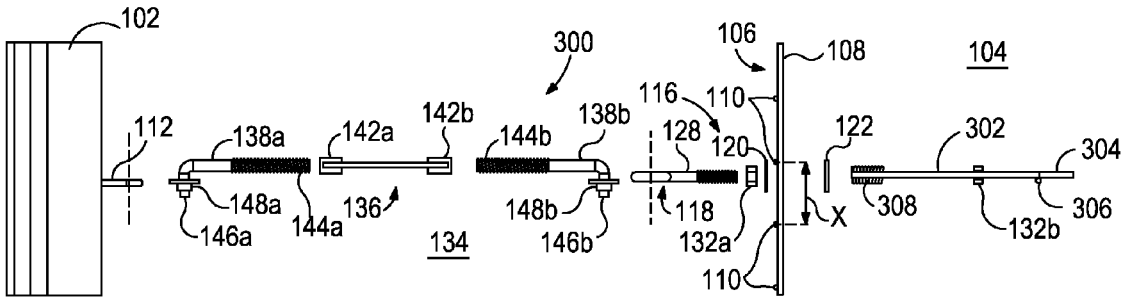
FIG. 3A illustrates an exploded side view of another exemplary two-stage MSE system, according to one or more embodiments described.
Figure 3B:
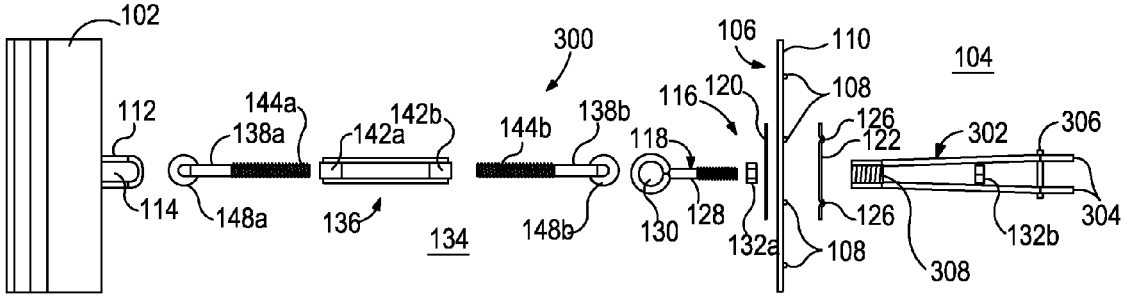
FIG. 3B illustrates an exploded plan view of the two-stage MSE system shown in FIG. 3A.

Referring now to FIGS. 3A and 3B, illustrated are side and plan views, respectively, of another exemplary two-stage MSE system 300, according to one or more embodiments described. The system 300 may be similar in several respects to the system 100 described above with reference to FIGS. 1A and 1B. Accordingly, the system 300 may be best understood with reference to FIGS. 1A and 1B, where like numerals are used to indicate like components and therefore will not be described again in detail. Similar to system 100, the system 300 may be used to secure the facing 102 to the earthen formation 104 via the connections made between the turnbuckle assembly 136, facing anchor 112, and formation anchor 116. At least one difference between the systems 100 and 300, however, is that the system 300 includes or is also coupled to a soil reinforcing element 302 that extends horizontally into the earthen formation 104.

The soil reinforcing element 302 may include a pair of longitudinal wires 304 that extend substantially parallel to each other. In other embodiments, there could be more than two longitudinal wires 304 without departing from the scope of the disclosure. The longitudinal wires 304 may be joined to one or more transverse wires 306 in a generally perpendicular fashion by welds at each intersection, thus forming a welded wire gridworks. The lead ends of the longitudinal wires 304 may generally converge and be welded or otherwise attached to a coil 308. Each lead end of the longitudinal wires 304 may define deformations thereon configured to provide a more suitable welding surface for attachment to the coil 308. In one embodiment, the deformations may be positive deformations, such as those obtained in cold-working processes making positively defined bar stock. In other embodiments, the deformations may be negative deformations, such as those found on rebar. In at least one embodiment, the entire soil reinforcing element 302 (including each longitudinal wire 304 and transverse wire 306) may be made of positively deformed bar stock. Using positively deformed bar stock may prove advantageous since it exhibits higher yield strength in tensile testing and also improves the pullout value from the backfill soil.

The coil 308 may include a plurality of indentations or grooves defined along its axial length. The grooves may also be configured to provide a more suitable welding surface for attaching the longitudinal wires 304, since the grooves can increase the strength of a resistance weld. In one embodiment, the coil 308 can be a compressed coil spring. In other embodiments, the coil 308 may be a nut or coil rod welded to the longitudinal wires 304.

Figure 4A:
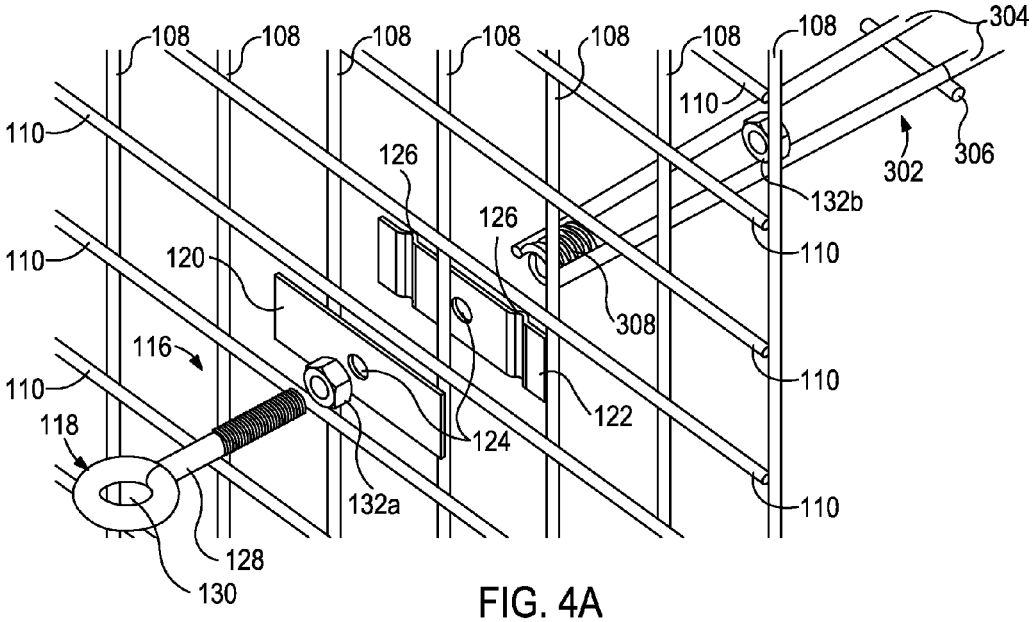
FIG. 4A illustrates an exploded, isometric view of a portion of the two-stage MSE system shown in FIG. 3A, according to one or more embodiments described.
Figure 4B:
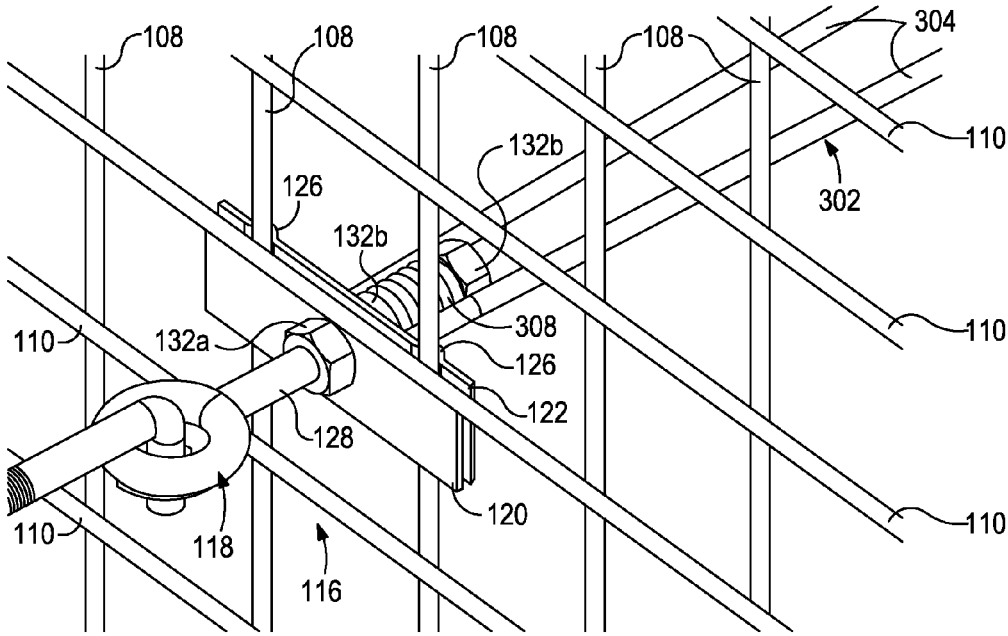
FIG. 4B illustrates an assembled, isometric view of the portion of the two-stage MSE system shown in FIG. 4A.

In one or more embodiments, the soil reinforcing element 302 may be coupled or otherwise attached to the formation anchor 116 at the wire grid 16. Referring to FIGS. 4A and 4B, with continued reference to FIGS. 3A and 3B, the soil reinforcing element 302 and formation anchor 116 are illustrated in exploded and assembled or coupled views, respectively. FIGS. 4A and 4B are substantially similar to FIGS. 2A and 2B described above. Accordingly, FIGS. 4A and 4B will be best understood with reference to FIGS. 2A and 2B, where like numerals are used to indicate like components and will therefore not be described again in detail.

To couple the formation anchor 116 to the wire grid 106 and simultaneously to the soil reinforcing element 302, the first securing device 132*a* is first threaded onto the stem 128. The stem 128 may then be successively extended through the hole 124 defined in the face plate 120, the wire grid 106, the hole 124 defined in the wave plate 122, and finally through the coil 308. The second securing device 132*b* may then be threaded onto the distal end of the stem 128 and tightened until bringing the coil 308 and/or longitudinal wires 304 into contact with the back surface of the wave plate 122. Further rotation or advancement of the second securing device 132*b* along the length of the stem 128 will urge the wave plate 122 into contact with the wire grid 106, where adjacent vertical wires 108 may be aligned with and seated within the transverse protrusions 126. Securing the adjacent vertical wires 108 within the transverse protrusions 126 may help to prevent the formation anchor 116, and also the soil reinforcing element 302, from translating laterally.

Referring again to FIG. 3A, each cross wire 110 of the wire grid 106 may be vertically-offset from each other by a distance X. Consequently, the formation anchor 116 and the soil reinforcing element 302 may be coupled to the wire grid 106 such that each is capable of shifting vertically for the distance X. This may prove advantageous in applications where either the facing 102 or the earthen formation 104 settles or otherwise thermally expands or contracts and vertical translation is demanded.

Referring now to FIG. 5, illustrated is an exploded plan view of another embodiment of the formation anchor 116 connected to both the wire grid 106 and a soil reinforcing element 302. In one embodiment, the eye bolt 118 may define an enlarged thread pattern 502 on the stem 128. For example, the thread pattern 502 may include coil threads and the coil 308 may be configured to threadably receive such a thread pattern 502. In at least one embodiment, coil threads can include a larger than normal thread pattern, such as coarse threads, acme threads, or similarly manufactured threading. Consequently, the second securing device 132*b* (FIGS. 4A and 4B) may be entirely omitted. The first securing device 132*a* may also be internally threaded in order to accommodate the thread pattern 502. In other embodiments, the first securing device 132*a* may be replaced with a coil nut or similar device, for example, a coil similar to the coil 308 of the soil reinforcing element 302.

Equally applicable to the previously disclosed embodiments, the eye bolt 118 may be fully capable of moving in at least three directions. For example, rotating the eye bolt 118 about its axis Y moves the eye bolt 118 horizontally, either toward the back face of the wire grid 106 or away from the wire grid 106 and further into the cavity 134, as shown by directional arrows 504. Secondly, rotating the eyebolt 118 about its axis Y may also serve to adjust the general angular disposition of the aperture 130. As can be appreciated, such movement (i.e., horizontal and angular) can prove advantageous in connecting to varying types of turnbuckle assemblies 136 (FIGS. 3A and 3B) which may require varying horizontal and/or angular configurations of the eye bolt 118. Lastly, as described above, the eye bolt 118 is also capable of shifting vertically by the distance X (FIGS. 3A and 3B) to adapt to changing MSE conditions, such as settling and thermal contraction or expansion cycles.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A system for securing a facing to an earthen formation, comprising:

a wire grid laterally-offset from the facing and being fixed relative to the earthen formation in a substantially vertical position, the wire grid having a plurality of vertical wires coupled to a plurality of cross wires;

a formation anchor comprising:

a first plate defining a first hole, a second plate defining a second hole, the second plate being a wave plate comprising at least two transverse protrusions laterally-offset from each other and configured to align with adjacent vertical wires of the wire grid;

an eyebolt defining an aperture and having a stem extending from the aperture, wherein the stem is extensible through the first hole, the wire grid, and the second hole, successively, in order to couple the formation anchor to the wire grid;

a first securing device coupled to the stem and configured to bias the first plate against an outside surface of the wire grid; and a second securing device engageable with an end of the stem, the second securing device being configured to bias the wave plate against an inside surface of the wire grid, whereby the at least two transverse protrusions receive the adjacent vertical wires;

a facing anchor coupled to the facing; and a turnbuckle housing having boreholes defined at first and second ends thereof, wherein a first connector is threadably coupled to the first end and also coupled to the formation anchor, and a second connector is threadably coupled to the second end and also coupled to the facing anchor.

2. The system of claim 1, wherein the plurality of cross wires are vertically-offset from each other a distance, and the formation anchor is capable of translating vertically over the distance when coupled to the wire grid.

3. The system of claim 1, wherein the first and second securing devices are adjustable to adjust a lateral disposition of the eye bolt with respect to the outside surface of the wire grid.

4. The system of claim 1, wherein one or both of the first and second securing devices are attached directly to one or both of first and second plates, respectively.

5. The system of claim 1, wherein the first connector is an L-bolt having a threaded end secured against removal from the aperture with a nut.

6. A system for securing a facing to an earthen formation, comprising:

a wire grid laterally-offset from the facing and fixed relative to the earthen formation in a substantially vertical position, the wire grid having a plurality of vertical wires coupled to a plurality of cross wires;

a formation anchor comprising:

a first plate defining a first hole;

a second plate defining a second hole, the second plate comprising at least two transverse protrusions laterally-offset from each other and configured to align with adjacent vertical wires of the wire grid;

an eyebolt defining an aperture and having a stem extending therefrom, wherein the stem is extensible through the first hole, the wire grid, and the second hole, successively;

a first securing device coupled to the stem and configured to bias the first plate against an outside surface of the wire grid; and a second securing device engageable with an end of the stem, the second securing device being configured to bias the coil against the second plate which biases the second plate against an inside surface of the wire grid, whereby the at least two transverse protrusions receive the adjacent vertical wires;

a soil reinforcing element comprising a plurality of transverse wires coupled to at least two longitudinal wires having lead ends that converge and are coupled to a coil;

a facing anchor coupled to the facing; and a turnbuckle housing having boreholes defined at first and second ends thereof, wherein a first connector is threadably coupled to the first end and also coupled to the formation anchor, and a second connector is threadably coupled to the second end and also coupled to the facing anchor.

7. The system of claim 6, wherein the first and second securing devices are adjustable to adjust the lateral disposition of the eye bolt with respect to the outside surface of the wire grid.

8. The system of claim 6, wherein one or both of the first and second securing devices are attached directly to one or both of first and second plates, respectively, and the lateral disposition of the eye bolt with respect to the outside surface of the wire grid is adjusted by rotating the eyebolt.

9. The system of claim 6, wherein the stem defines coil threads configured to threadably engage the coil.

10. The system of claim 6, wherein the plurality of cross wires are vertically-offset from each other a distance, and the formation anchor is capable of translating vertically over the distance when coupled to the wire grid.

11. A system for securing a facing to an earthen formation, comprising:

a wire grid laterally-offset from the facing and being fixed relative to the earthen formation in a substantially vertical position, the wire grid having a plurality of vertical wires coupled to a plurality of cross wires;

a formation anchor comprising:

a first plate defining a first hole, the first plate being a wave plate comprising at least two transverse protrusions laterally-offset from each other and configured to align with adjacent vertical wires of the wire grid;

a second plate defining a second hole;

an eyebolt defining an aperture and having a stem extending from the aperture, wherein the stem is extensible through the first hole, the wire grid, and the second hole, successively, in order to couple the formation anchor to the wire grid;

a first securing device coupled to the stem and configured to bias the wave plate against an outside surface of the wire grid whereby the at least two transverse protrusions receive the adjacent vertical wires; and a second securing device engageable with an end of the stem, the second securing device being configured to bias the second plate against an inside surface of the wire grid;

a facing anchor coupled to the facing; and a turnbuckle housing having boreholes defined at first and second ends thereof, wherein a first connector is threadably coupled to the first end and also coupled to the formation anchor, and a second connector is threadably coupled to the second end and also coupled to the facing anchor.

12. The system of claim 11, wherein one or both of the first and second securing devices are attached directly to one or both of first and second plates, respectively.

* * * * *